US008617298B2

(12) United States Patent
Nakahara et al.

(10) Patent No.: US 8,617,298 B2
(45) Date of Patent: Dec. 31, 2013

(54) ELECTRICAL DUST PRECIPITATOR

(75) Inventors: Kengo Nakahara, Aichi (JP); Ryou Katou, Aichi (JP)

(73) Assignee: Panasonic Corporation, Osaka (JP)

( * ) Notice: Subject to any disclaimer, the term of this patent is extended or adjusted under 35 U.S.C. 154(b) by 477 days.

(21) Appl. No.: 13/059,471

(22) PCT Filed: Aug. 19, 2009

(86) PCT No.: PCT/JP2009/003936

§ 371 (c)(1),
(2), (4) Date: Feb. 17, 2011

(87) PCT Pub. No.: WO2010/021128

PCT Pub. Date: Feb. 25, 2010

(65) Prior Publication Data

US 2011/0139009 A1 Jun. 16, 2011

(30) Foreign Application Priority Data

Aug. 21, 2008 (JP) ..... 2008-212339
Dec. 9, 2008 (JP) ..... 2008-312884

(51) Int. Cl.
*B03C 3/47* (2006.01)

(52) U.S. Cl.
USPC ..... 96/69; 96/79; 96/98; 96/99

(58) Field of Classification Search
USPC ..... 96/69, 77–79, 88, 98, 99; 95/59, 61, 79
See application file for complete search history.

(56) References Cited

U.S. PATENT DOCUMENTS

| | | | | | |
|---|---|---|---|---|---|
| 2,970,670 | A | * | 2/1961 | Nodolf | 96/79 |
| 3,985,524 | A | * | 10/1976 | Masuda | 96/32 |
| 4,313,741 | A | | 2/1982 | Masuda et al. | |
| 4,354,861 | A | * | 10/1982 | Kalt | 96/69 |
| 4,569,684 | A | * | 2/1986 | Ibbott | 96/79 |
| 4,673,416 | A | * | 6/1987 | Sakakibara et al. | 96/79 |
| 4,715,870 | A | * | 12/1987 | Masuda et al. | 96/67 |
| 5,466,279 | A | * | 11/1995 | Hattori et al. | 96/69 |
| 5,474,600 | A | * | 12/1995 | Volodina et al. | 96/57 |
| 5,614,002 | A | * | 3/1997 | Chen | 96/55 |
| 6,004,376 | A | * | 12/1999 | Frank | 95/79 |
| 6,187,271 | B1 | * | 2/2001 | Lee et al. | 422/121 |

(Continued)

FOREIGN PATENT DOCUMENTS

| | | |
|---|---|---|
| CN | 2423030 Y | 3/2001 |
| CN | 1364100 | 8/2002 |

(Continued)

OTHER PUBLICATIONS

International Search Report of PCT Application No. PCT/JP2009/003936, dated Dec. 1, 2009.

*Primary Examiner* — Richard L Chiesa
(74) *Attorney, Agent, or Firm* — Panasonic Patent Center

(57) ABSTRACT

An electrostatic precipitator is provided with a ionizing unit and a collecting unit placed on the downstream side of the ionizing unit, and the ionizing unit has discharge electrodes each of which generates a corona discharge and a ground electrode plate connected to the earth, and in this structure, the ground electrode plate is provided with an insulating substrate, a resistor formed on the surface of the insulating substrate and a conductive section that is electrically connected to the resistor on the surface of the insulating substrate, and the discharge electrodes face the resistor of the ground electrode plate at a predetermined interval.

20 Claims, 5 Drawing Sheets

(56) References Cited

U.S. PATENT DOCUMENTS

| | | | | |
|---|---|---|---|---|
| 6,635,106 | B2 * | 10/2003 | Katou et al. | 96/67 |
| 7,507,275 | B2 * | 3/2009 | Kim et al. | 96/69 |
| 2003/0005824 | A1 | 1/2003 | Katou et al. | |
| 2004/0226448 | A1 * | 11/2004 | Griffiths et al. | 96/67 |
| 2011/0139009 | A1 * | 6/2011 | Nakahara et al. | 96/95 |

FOREIGN PATENT DOCUMENTS

| | | | | |
|---|---|---|---|---|
| JP | 54-136476 | A * | 10/1979 | 96/79 |
| JP | 59-59258 | | 4/1984 | |
| JP | 62-34598 | | 9/1987 | |
| JP | 62-34598 | Y | 9/1987 | |
| JP | 4-9652 | | 1/1992 | |
| JP | 4-9652 | U | 1/1992 | |
| JP | 8-131885 | | 5/1996 | |
| JP | 9-117693 | | 5/1997 | |
| JP | 10-296129 | | 11/1998 | |
| JP | 11-342350 | | 12/1999 | |
| JP | 2008-62173 | | 3/2008 | |
| JP | 2008-183540 | | 8/2008 | |

* cited by examiner

ELECTRICAL DUST PRECIPITATOR

TECHNICAL FIELD

The invention relates to an electrostatic precipitator to be used for collecting suspended particulate matters in the air to clean air.

BACKGROUND ART

Conventionally, as the electrostatic precipitator of this type, the following apparatus has been known, and referring to FIG. 5 that is a front view showing the conventional electrostatic precipitator, a description will be given thereto (for example, refer to Patent Document 1).

As shown in FIG. 5, the electrostatic precipitator is provided with ground electrode plate 101 having a plate shape that is disposed in parallel with an air flow, and is also provided with discharge electrode 104 composed of supporting member 102 and a plurality of needle-shaped electrodes 103, which is disposed in parallel therewith.

By supplying a DC high voltage to discharge electrode 104 from a DC high voltage power supply, a corona discharge is generated between ground electrode plate 101 and discharge electrode 104 so that suspended particulate matters in the air are charged and collected.

The material for ground electrode plate 101 is metal, such as steel, stainless steel and aluminum. Moreover, as the material for needle-shaped electrodes 103, normally steel, stainless steel, or the like may be used; however, by taking into consideration a corrosive property and a corrosion resistant property, metals, such as titanium, iridium, platinum, rhodium and tungsten, or alloys of these may be used in some cases.

In this case, the electrode-to-electrode distance between ground electrode plate 101 and needle-shaped electrodes 103 of discharge electrode 104 is set to 30 mm, and an applied voltage to needle-shaped electrodes 103 is set to 18 kV.

In such a conventional electrostatic precipitator, when the electrode-to-electrode distance between ground electrode plate 101 and needle-shaped electrodes 103 of discharge electrode 104 is made too narrow, a spark discharge frequently occurs, resulting in a problem that an inherent dust collecting performance of the electrostatic precipitator is no longer obtained. Although this problem can be solved when the electrode-to-electrode distance is widened, the widened distance causes a reduction in a corona discharge quantity of the entire electrostatic precipitator, resulting in degradation of the dust collecting performance of the electrostatic precipitator.

In the conventional electrostatic precipitator, the electrode-to-electrode distance is widened to a distance (for example, 30 mm as described above) that no longer causes a spark discharge frequently. For this reason, since the corona discharge quantity from discharge electrode 104 becomes smaller, a plurality of discharge electrodes 104 are disposed in a direction of an air flow so that an attempt is made to ensure a sufficient corona discharge quantity so as to maintain a sufficient dust collecting performance.

Moreover, in accordance with this structure, plate-shaped ground electrode plate 101 also becomes larger in the direction of the air flow. Consequently, the apparatus as a whole becomes bulky in the direction of the air flow. The resulting problem is that, upon installation in a factory or the like, in the case of the installation on a floor, no margin space is sufficiently prepared because of various machine facilities placed therein, and in the case of the installation on a semi-second floor or a ceiling, it is difficult to ensure a sufficient space, because ducts for normal ventilation, air conditioning machines, cranes, illuminating devices, and the like are installed thereon.

PRIOR ART DOCUMENT

Patent Document

Patent Document 1: Unexamined Japanese Patent Publication No. 1984-59258

DISCLOSURE OF THE INVENTION

An electrostatic precipitator in accordance with the present invention is provided with a ionizing unit, and a collecting unit placed on the downstream side of the ionizing unit, and the ionizing unit has discharge electrodes each of which generates a corona discharge and a ground electrode plate connected to the earth, and in this structure, the ground electrode plate is provided with an insulating substrate, a resistor formed on the surface of the insulating substrate, and a conductive section that is electrically connected to the resistor on the surface of the insulating substrate, and the discharge electrodes face the resistor of the ground electrode plate at a predetermined interval.

In this electrostatic precipitator, since the discharge electrodes face the resistor of the ground electrode plate at a predetermined interval, no spark discharge is generated even when the resistor of the ground electrode plate is placed closely to the discharge electrode. Moreover, since the resistor of the ground electrode plate and the discharge electrode can be placed closely to each other, the precipitator can be miniaturized and is allowed to ensure a high dust collecting performance.

PREFERRED EMBODIMENTS FOR CARRYING OUT OF THE INVENTION

Figure 1:
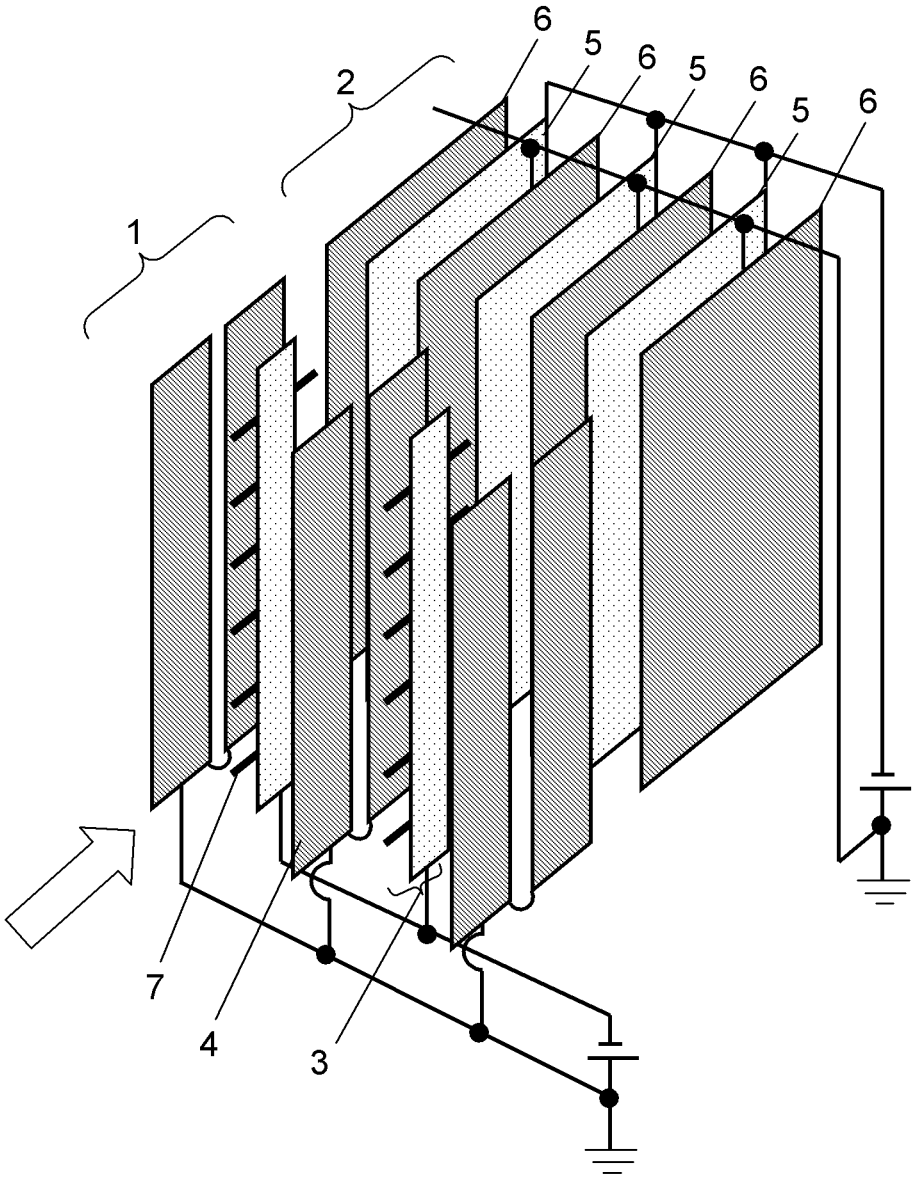
FIG. 1 is a perspective view that shows an electrostatic precipitator in accordance with Embodiment 1 of the present invention.

Referring to the drawings, the following description will discuss embodiments of the present invention.

Embodiment 1

Figure 2A:
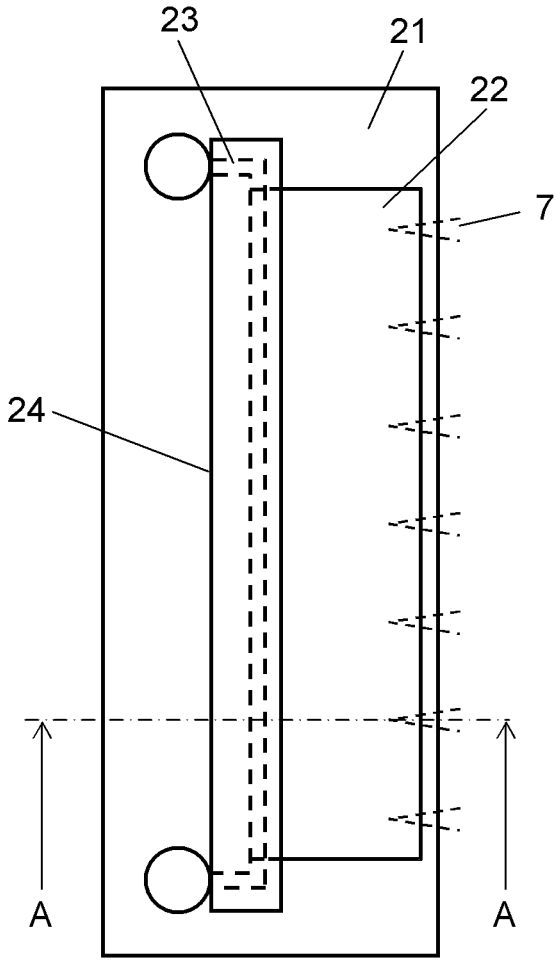
FIG. 2A is a plan view that shows a specific structure of a ground electrode plate of the electrostatic precipitator in accordance with Embodiment 1 of the present invention.
Figure 2B:
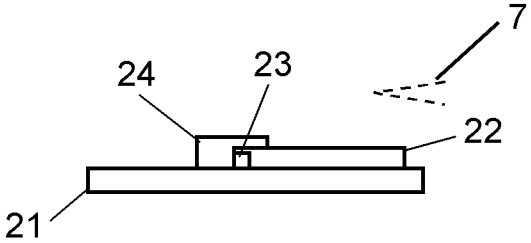
FIG. 2B is a cross-sectional view taken along A-A line of FIG. 2A.

FIG. 1 is a perspective view that shows an electrostatic precipitator in accordance with Embodiment 1 of the present invention, FIG. 2A is a plan view that shows a specific structure of a ground electrode plate of the electrostatic precipitator in accordance with Embodiment 1 of the present invention, and FIG. 2B is a cross-sectional view taken along A-A line of FIG. 2A.

As shown in FIG. 1, the electrostatic precipitator of Embodiment 1 of the present invention has a structure in which collecting unit 2 is disposed on the downstream side of ionizing unit 1, along an air flow (arrow in FIG. 1) for collecting dusts.

Ionizing unit 1 has a structure in which discharge electrode plate 3 that applies a high voltage and ground electrode plate 4 connected to the earth are disposed face to face with each other on the two sides in an air flow direction (an arrow direction), with a predetermined distance (for example, 15 mm to 20 mm) between them. Moreover, discharge electrodes 7 that generate a corona discharge are installed on discharge electrode plate 3.

Collecting unit 2 has a structure in which charging electrode plate 5 that applies a high voltage and dust collecting electrode plate 6 (for example, a stainless steel plate) connected to the earth are disposed face to face with each other on the two sides in the air flow direction (arrow direction), with a predetermined distance between them.

In this case, air is allowed to flow through a gap formed between discharge electrode plate 3 and ground electrode plate 4 of ionizing unit 1 that are placed apart from each other with a predetermined distance, and a gap formed between charging electrode plate 5 and dust collecting electrode plate 6 of collecting unit 2 that are placed apart from each other with a predetermined distance, as indicated by an arrow.

Then, in ionizing unit 1, suspended particulate matters in the air are charged with a negative potential by a corona discharge (a negative discharge in Embodiment 1 of the present invention) generated between discharge electrode plate 3 and ground electrode plate 4.

Moreover, in collecting unit 2, by an electric field generated between charging electrode plate 5 (a negative voltage application in Embodiment 1 of the present invention) and dust collecting electrode plate 6 (which forms a positive pole relatively, although connected to the earth in Embodiment 1 of the present invention), the suspended particulate matters charged with a negative potential in ionizing unit 1 are allowed to adhere to dust collecting electrode plate 6 (positive pole) by a Coulomb force, and collected thereon.

FIGS. 2A and 2B are detailed views of ground electrode plate 4 of ionizing unit 1, which has resistor 22 having a film structure, conductive section 23 having a film structure, and insulating substance 24 having a film structure that are disposed on a surface of insulating substrate 21.

Each of insulating substrate 21 and resistor 22 has a rectangular shape, with their lengths in the longitudinal direction being aligned with each other. Moreover, conductive section 23 has an elongated belt shape. In this shape, a longitudinal portion of conductive section 23 is electrically connected to one side of resistor 22 (side opposite to discharge electrode 7) in such a manner that discharge electrode 7 and conductive section 23 are separated from each other as far as possible.

Moreover, to plurality of needle-shaped discharge electrodes 7 (in Embodiment 1 of the present invention, needle-shaped discharge electrodes 7 made of stainless steel, with its tip diameter being set to 20 μm or less) formed on discharge electrode plate 3, a high voltage of −8 kV is applied in Embodiment 1 of the present invention.

These discharge electrodes 7 and resistor 22 placed opposed thereto are separated from each other with a predetermined distance (15 mm to 20 mm in Embodiment 1 of the present invention; however, upon application of a high voltage of −8 kV to discharge electrodes 7, a corona discharge is generated in a space between needle-shaped discharge electrodes 7 and resistor 22 so that suspended particulate matters are charged as described earlier.

Resistor 22, made of a burning film, is formed in the following manner. First, a glass paste containing a conductive substance (at least one of ruthenium oxide, tin oxide, and antimony oxide) of non-alkaline metal oxide is screen-printed on insulating substrate 21. Thereafter, insulating substrate 21 is heated at 850° C. so that its glass component is fused to form resistor 22 (in Embodiment 1 of the present invention, this process is expressed as being formed by firing).

Moreover, in order to form the above-mentioned resistor 22, insulating substrate 21 needs to be formed by a material that is resistive to high temperatures, and in Embodiment 1 of the present invention, a ceramic substrate (that has been fired), mainly composed of aluminum oxide that is a low cost material, is used. Additionally, not limited to aluminum oxide, any other materials may be used as long as they are resistant to high temperatures. By using resistor 22 on the two surfaces of one insulating substrate 21, the amount of use of insulating substrate 21 can be reduced.

In the case where resistor 22 having a film structure, conductive section 23 having a film structure, and insulating substance 24 having a film structure are formed on the surface of insulating substrate 21 by using an adhesive, this insulating substrate 21 itself is not necessarily required to be made of ceramics, and this may be formed by using a synthetic resin plate.

Conductive section 23 made of a burning film is formed through processes in which, after a paste containing a conductive substance, such as silver, copper, and tungsten, has been screen-printed on insulating substrate 21, the resulting substrate is fired. As described in FIG. 1, conductive section 23 is connected to the earth (not shown). Additionally, not limited to the firing process of a paste, conductive section 23 may be formed by vapor depositing a conductive substance on insulating substrate 21. Moreover, this may be formed by placing a copper foil on insulating substrate 21.

Additionally, by forming conductive section 23 using a burning film, a facility used for forming resistor 22 can be commonly utilized.

Insulating substance 24 is formed in a manner so as to cover the entire surface of conductive section 23 and the surface of a contact unit (not shown) that electrically connects resistor 22 to conductive section 23.

More specifically, a glass paste to be used for resistor 22 (glass paste containing at least one of ruthenium oxide, tin oxide, and antimony oxide, as one example of the conductive substances), a paste used for conductive section 23 (paste containing a conductive substance, such as silver, copper, and tungsten), and a glass paste used for insulating substance 24 (insulating glass paste containing none of the above-mentioned ruthenium oxide, tin oxide, and antimony oxide) are screen-printed on insulating substrate 21, and the resulting substrate is then heated at 850° C. (as described above) to be formed into an integral unit.

Insulating substance 24 is formed so as to protect conductive section 23. In the case where no insulating substance 24 is formed, upon adhesion of moisture to the surface of resistor 22 due to dew condensation or the like, a portion of resistor 22 close to discharge electrodes 7 and the surface of conductive section 23 tend to cause short circuits. This arrangement is prepared to prevent these short circuits.

In order to prevent these short circuits, Embodiment 1 of the present invention has a structure in which, as described above, the entire surface of conductive section 23 and the surface of the contact portion between conductive section 23 and resistor 22 are covered with insulating substance 24.

Moreover, since ozone and ultraviolet rays are discharged by a corona discharge in its applied environment, insulating substance 24 is formed by glass that is an inorganic substance having high durability to these.

Discharge electrode 7 has a structure in which two tips of one round rod are formed into sharpened edges (or may have a structure formed by cutting out a metal plate so as to have a plurality of spines).

In this case, as shown in FIG. 2, resistor 22, conductive section 23, and discharge electrodes 7 are disposed so that the tips of discharge electrodes 7 face resistor 22 at a predetermined interval (for example, 15 mm to 20 mm), with conductive section 23 being placed apart from discharge electrodes 7.

Next, in Embodiment 1 of the present invention, the following description will discuss a function for properly maintaining performances of an electric dust precipitator, while miniaturizing the size of the electric dust precipitator.

In ionizing unit 1, discharge electrodes 7 and resistor 22 are allowed to generate a corona discharge. In particular, since resistor 22 is formed to have the above-mentioned structure (in which, after a glass paste containing a conductive substance has been screen-printed on insulating substrate 21, this is heated to fuse the glass component to form the structure), a basic resistance value is sufficiently high so that a current that flows upon discharging is limited to prevent such a large current as to cause a spark discharge from being allowed to flow. Therefore, a spark discharge is prevented.

So as to allow discharge electrodes 7 and resistor 22 to generate an appropriate corona discharge, resistor 22 is formed by processes in which, as described earlier, a glass paste containing at least one of ruthenium oxide, tin oxide, and antimony oxide, serving as one example of a conductive substance, is printed, and then heated to form the corresponding structure. Resistor 22 has a resistance value that is lower than that of insulating substance 24 mainly used for insulation.

Note that, in Embodiment 1 of the present invention, at least one of ruthenium oxide, tin oxide, and antimony oxide, serving as one example of a conductive substance, is used, and by mixing these, a conductive property that is suitable for generating a corona discharge is exerted. The reason for this is because these conductive substances have oxygen defect so that electron mobility is generated.

Although resistor 22 is formed by using at least one of ruthenium oxide, tin oxide, and antimony oxide, as a metal oxide, this may be formed by using other metal oxides.

Moreover, conductive section 23 is electrically connected to resistor 22 at a position apart from the discharge electrodes 7 (on the side opposite to the aforementioned discharge electrodes 7). That is, resistor 22 is electrically connected to conductive section 23.

For this reason, the portion of resistor 22 (near discharge electrodes 7) apart from conductive section 23 has a high resistance value, while the portion of resistor 22 (apart from discharge electrodes 7) close to conductive section 23 has a low resistance value. With this arrangement, an appropriate corona discharge can be generated between discharge electrodes 7 and resistor 22.

Since resistor 22 faces discharge electrodes 7, no spark discharge is generated even when discharge electrodes 7 are made closer to resistor 22. Therefore, the gap between discharge electrodes 7 and resistor 22 can be narrowed (for example, a gap of 30 mm in a conventional structure is narrowed to 15 mm to 20 mm in Embodiment 1 of the present invention) so that the entire size of an electrostatic precipitator can be made smaller, without causing degradation of dust collecting performances.

In order to achieve these functions, Embodiment 1 of the present invention sets the surface resistivity of resistor 22 in a range from $10^6$ to $10^{10}\Omega/\square$, more preferably, from $10^7$ to $10^8\Omega/\square$. That is, when the surface resistivity of resistor 22 is too low, a spark discharge occurs, while when it is too high, a corona discharge is no longer generated; therefore, the resistivity is preferably maintained at this value.

Moreover, as insulating substrate 21, a ceramic substrate, with its surface being non-polished, is used, and resistor 22 is formed on the surface by printing, as described earlier.

For this reason, fine uneven portions that are present on the surface of the ceramic substrate are also transferred and formed onto the surface of resistor 22.

Consequently, the corona discharge is brought into such a state as to widely spread, in particular, toward the convex portions so that this structure makes it possible to improve the dust collecting effect of charge.

Embodiment 2

Figure 3:
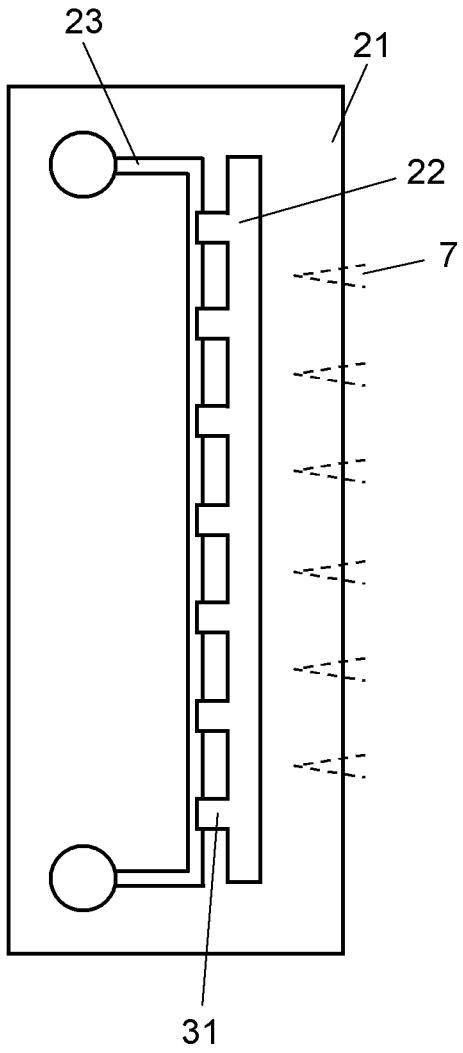
FIG. 3 is a plan view that shows a specific structure of a ground electrode plate of an electrostatic precipitator in accordance with Embodiment 2 of the present invention.

The following description will discuss an electrostatic precipitator in accordance with Embodiment 2 of the present invention. In Embodiment 2 of the present invention, with respect to those components that are the same as those of Embodiment 1, detailed description thereof will be omitted, and only different points will be described. FIG. 3 is a plan view that shows a specific structure of a ground electrode plate of an electrostatic precipitator of Embodiment 2 of the present invention.

Resistor 22 having a rectangular shape is installed so as to be made in parallel with a line formed by connecting the tips of needle-shaped discharge electrodes 7 with one another.

Moreover, in association with connecting sections 31 that electrically connect conductive section 23 with resistor 22, the tips of discharge electrodes 7 are designed so as to be located between adjacent connecting sections 31. In this case, a gap between adjacent connecting sections 31 corresponds to a space from which two side edges of connecting sections 31 are excluded. This structure is prepared so as to prevent a spark discharge.

In other words, in FIG. 3, the tips of discharge electrodes 7 and conductive section 23 are close to each other. Moreover, conductive section 23 and the upper portions of conductive section 23 and connecting sections 31 are not covered with insulating substance 24. For this reason, when connecting sections 31 are located on extended lines from discharge electrodes 7, the resistance value of resistor 22 becomes smaller to cause a spark discharge.

Therefore, in FIG. 3, each of the tips of discharge electrodes 7 is designed to be located between adjacent connecting sections 31.

A patterned shape of resistor 22, as shown in FIG. 3, is effectively used when the intervals between discharge electrodes 7 are narrow, and since the discharge range from one discharge electrode 7 is sufficiently maintained, it becomes possible to prevent the dust collecting performance from being lowered.

That is, by allowing the tips of discharge electrodes 7 to be located between adjacent connecting sections 31, the distance inside resistor 22 from each discharge electrode 7 to conductive section 23, with connecting unit 31 located therebetween, is made longer. For this reason, resistor 22 is allowed to maintain a sufficient resistance value.

Moreover, with this structure, the portion of resistor 22 located close to the tips of discharge electrodes 7 has a shorter distance to the tips of discharge electrodes 7; however, the distance inside resistor 22 up to conductive section 23 becomes longer correspondingly. Furthermore, each portion of resistor 22 located between adjacent connecting sections 31 has a longer distance from the tips of discharge electrodes 7; however, the distance inside resistor 22 up to conductive section 23 becomes shorter correspondingly. As a result, it is possible to ensure a sufficient discharge range from each discharge electrode 7, and consequently to prevent the dust collecting performance from being lowered.

Embodiment 3

Figure 4:
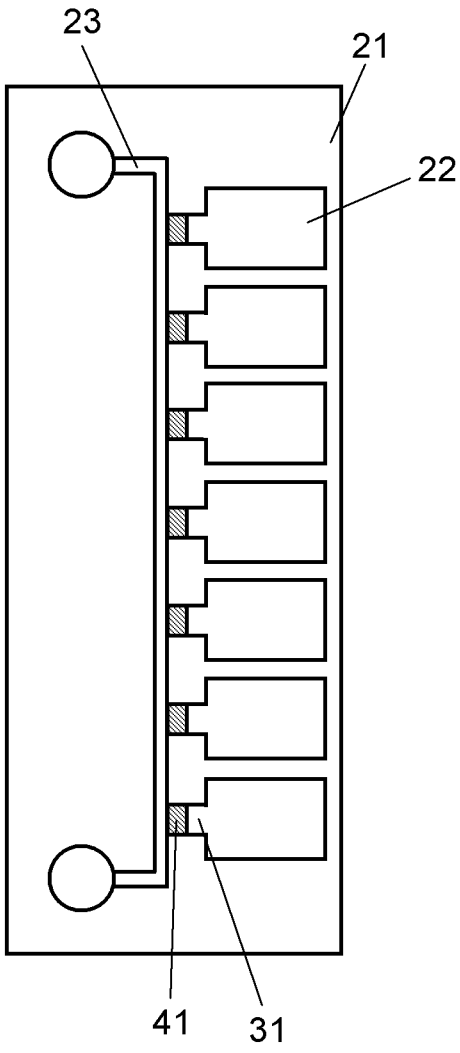
FIG. 4 is a plan view that shows a specific structure of a ground electrode plate of an electrostatic precipitator in accordance with Embodiment 3 of the present invention.
Figure 5:
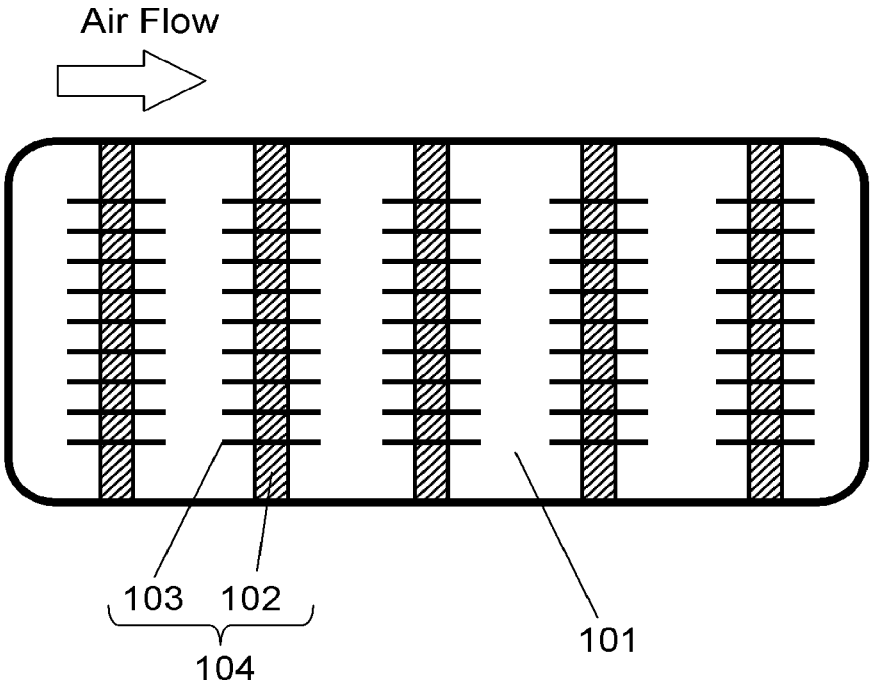
FIG. 5 PRIOR ART
FIG. 5 is a front view that shows a conventional electrostatic precipitator.

The following description will discuss an electrostatic precipitator in accordance with Embodiment 3 of the present invention. In Embodiment 3 of the present invention, with respect to those components that are the same as those of Embodiments 1 and 2, detailed description thereof will be omitted, and only different points will be described. FIG. 4 is a detailed view that shows a structure of a ground electrode plate of an electrostatic precipitator of Embodiment 3 of the present invention.

As shown in FIG. 4, on an aluminum oxide substrate serving as insulating substrate 21, a resistor paste to form resistor 22 and a conductive paste to form conductive section 23 are formed as patterns. Moreover, a current fuse or a thermal fuse serving as current blocking means 41 is electrically interposed in series between resistor 22 and conductive section 23, at connecting sections 31 between resistor 22 and conductive section 23.

For example, in the case where opposed discharge electrode 7 is bent to be brought into contact with resistor 22, or if a conductive thin fiber-shaped matter flies to adhere to cause a short circuit between discharge electrode 7 and resistor 22, a high voltage applied to discharge electrode 7 is directly imposed on resistor 22. Even in this case, current blocking means 41 blocks the electric circuit off to stop the application of the voltage to discharge electrode 7.

In Embodiment 3 of the present invention, since upon short-circuiting between discharge electrode 7 and resistor 22, an electric current of about 100 μA is allowed to flow, the fusing-current of an electric current fuse is desirably set to 100 μA. Moreover, in the case of a thermal fuse, since the flash point of cutting oil that is a flammable material is in a range from 140° C. to 190° C., the fusing temperature is desirably set to 140° C.

INDUSTRIAL APPLICABILITY

The electrostatic precipitator of the present invention is effectively used as an air cleaning system when any flammable material is contained in suspended particulate matters in the air. Moreover, by installing a resistor on a ground electrode plate of a ionizing unit, the electrostatic precipitator of the present invention makes it possible to suppress occurrence of a spark discharge, and also to miniaturize the apparatus, with a sufficient dust collecting efficiency being maintained.

| REFERENCE MARKS IN THE DRAWINGS | |
|---|---|
| 1 | Ionizing unit |
| 2 | Collecting unit |

-continued

| REFERENCE MARKS IN THE DRAWINGS | |
|---|---|
| 3 | Discharge electrode plate |
| 4 | Ground electrode plate |
| 5 | Charging electrode plate |
| 6 | Dust collecting electrode plate |
| 7 | Discharge electrode |
| 21 | Insulating substrate |
| 22 | Resistor |
| 23 | Conductive section |
| 24 | Insulating substance |
| 31 | Connecting section |
| 41 | Current blocking means |

The invention claimed is:

1. An electrostatic precipitator comprising:

a ionizing unit; and a collecting unit placed on the downstream side of the ionizing unit, wherein the ionizing unit is provided with discharge electrodes each of which generates a corona discharge, and a ground electrode plate connected to the earth, the ground electrode plate is provided with an insulating substrate, a resistor formed on the surface of the insulating substrate, and a conductive section that is electrically connected to the resistor and to the earth, and the discharge electrodes face the resistor of the ground electrode plate at a predetermined interval.

2. The electrostatic precipitator according to claim 1, wherein the resistor is formed into a plate shape, and the conductive section is electrically connected to one side of the resistor.

3. The electrostatic precipitator according to claim 2, wherein on the surface of the insulating substrate, the surface of the conductive section and the surface of a connecting section between the conductive section and the resistor are covered with an insulating substance.

4. An electrostatic precipitator comprising:

a ionizing unit; and a collecting unit placed on the downstream side of the ionizing unit, wherein the ionizing unit is provided with discharge electrodes each of which generates a corona discharge, and a ground electrode plate connected to the earth, the ground electrode plate is provided with an insulating substrate made of a ceramic substrate, a resistor made of a burning film that is formed on the surface of the insulating substrate, and a conductive section that is electrically connected to the resistor and to the earth, and the discharge electrodes face the resistor of the ground electrode plate at a predetermined interval.

5. The electrostatic precipitator according to claim 4, wherein the conductive section is made of a burning film.

6. The electrostatic precipitator according to claim 4, wherein the surface of the conductive section and the surface of a connecting section between the conductive section and the resistor are covered with an insulating substance.

7. The electrostatic precipitator according to claim 6, wherein the resistor contains a metal oxide.

8. The electrostatic precipitator according to claim 7, wherein the resistor contains a non-alkaline metal oxide.

9. The electrostatic precipitator according to claim 8, wherein the resistor contains at least one of ruthenium oxide, tin oxide, and antimony oxide.

10. The electrostatic precipitator according to claim 9, wherein the resistor has a surface resistivity in a range from $10^6$ to $10^{10}\Omega/\square$.

11. The electrostatic precipitator according to claim 10, wherein the resistor has a surface resistivity in a range from $10^7$ to $10^8\Omega/\square$.

12. An electrostatic precipitator comprising:

a ionizing unit; and a collecting unit placed on the downstream side of the ionizing unit, wherein the ionizing unit is provided with discharge electrodes each of which generates a corona discharge, and a ground electrode plate connected to the earth, the ground electrode plate is provided with an insulating substrate made of a ceramic substrate, a resistor made of a burning film that is formed on the surface of the insulating substrate, and a conductive section that is electrically connected to the resistor and to the earth, the resistor has an uneven surface, and the discharge electrodes face the surface of the resistor at a predetermined interval.

13. The electrostatic precipitator according to claim 12, wherein a ceramic substrate having a non-polished surface is used as the insulating substrate.

14. The electrostatic precipitator according to claim 13, wherein the conductive section is made of a burning film.

15. The electrostatic precipitator according to claim 14, wherein the surface of the conductive section and the surface of a connecting section between the conductive section and the resistor are covered with an insulating substance.

16. The electrostatic precipitator according to claim 15, wherein the resistor contains a metal oxide.

17. The electrostatic precipitator according to claim 16, wherein the resistor contains a non-alkaline metal oxide.

18. The electrostatic precipitator according to claim 17, wherein the resistor contains at least one of ruthenium oxide, tin oxide, and antimony oxide.

19. The electrostatic precipitator according to claim 18, wherein the resistor has a surface resistivity in a range from $10^6$ to $10^{10}\Omega/\square$.

20. The electrostatic precipitator according to claim 19, wherein the resistor has a surface resistivity in a range from $10^7$ to $10^8\Omega/\square$.

* * * * *